US009587452B2

(12) United States Patent
Bjorgum

(10) Patent No.: US 9,587,452 B2
(45) Date of Patent: Mar. 7, 2017

(54) CYCLE DEVICE

(75) Inventor: Stig Ove Bjorgum, Voss (NO)

(73) Assignee: Vosstech AS, Voss (NO)

( * ) Notice: Subject to any disclaimer, the term of this patent is extended or adjusted under 35 U.S.C. 154(b) by 681 days.

(21) Appl. No.: 14/113,819

(22) PCT Filed: Apr. 27, 2012

(86) PCT No.: PCT/EP2012/057744
§ 371 (c)(1),
(2), (4) Date: Dec. 11, 2013

(87) PCT Pub. No.: WO2012/146707
PCT Pub. Date: Nov. 1, 2012

(65) Prior Publication Data

US 2014/0102718 A1 Apr. 17, 2014

(30) Foreign Application Priority Data

Apr. 28, 2011 (NO) ..... 20110630

(51) Int. Cl.
*E21B 33/12* (2006.01)
*E21B 41/00* (2006.01)
*E21B 23/04* (2006.01)
*E21B 34/06* (2006.01)

(52) U.S. Cl.
CPC ..... *E21B 23/04* (2013.01); *E21B 33/12* (2013.01); *E21B 34/063* (2013.01); *E21B 41/00* (2013.01)

(58) Field of Classification Search
CPC ..... E21B 23/04; E21B 23/004; E21B 34/063; E21B 41/00; E21B 33/12; E21B 23/06
See application file for complete search history.

(56) References Cited

U.S. PATENT DOCUMENTS

| | | | |
|---|---|---|---|
| 2002/0046845 | A1 | 4/2002 | Rayssiguier |
| 2004/0118562 | A1 | 6/2004 | George |
| 2006/0169462 | A1 | 8/2006 | Bishop |

FOREIGN PATENT DOCUMENTS

| | | | |
|---|---|---|---|
| WO | WO 97/06344 | A | 2/1997 |
| WO | WO 2007078205 | A | 7/2007 |
| WO | WO 2009/041823 | A | 4/2009 |

*Primary Examiner* — Michael Wills, III
(74) *Attorney, Agent, or Firm* — Christian D. Abel

(57) ABSTRACT

Device for controlling and/or operating underwater equipment employed in connection with recovery of hydrocarbons. The device has a hollow sleeve with a number of recesses and a closed volume, in which recesses a movement mechanism, a stopper element and a block release element are mounted. Under cyclic loading, the movement mechanism will be moved relative to the stopper element and the block release element into a position where the block release element via a release pin will open up a connection between the closed volume and a number of relief recesses. At least one push rod is activated for operating in the device's longitudinal direction.

10 Claims, 4 Drawing Sheets

2/4

PRESSURE $P_0$
VOLUME $V_1$
PRESSURE $P_1$
PRESSURE $P_0$
VOLUME $V_1$

CYCLE DEVICE

FIELD OF THE INVENTION

The present invention relates to a device for controlling, activating and/or operating tools, instruments and underwater equipment employed in connection with various operations offshore, onshore or within other fields of application. The present invention also relates to a method for use of the device.

BACKGROUND OF THE INVENTION

In the course of various operations conducted in connection with exploration and recovery of hydrocarbons offshore and onshore, tools and different underwater equipment are employed which by means of an activation mechanism, such as electrical signals, hydraulics, pneumatics, explosive charges or the like, are controlled and operated from an inactive or closed position to an active or open position. Examples of such underwater equipment may be different types of valves, well plugs etc.

Since serious consequences may result with regard to both cost and the environment if a valve or a plug, for example, opens inadvertently, or fails to open when it should, it is vital for the activation mechanism to be reliable and to function properly.

As an example we refer to the well-known situation within the oil industry where for a variety of reasons a well or a formation in the well has to be shut down or leakage/pressure-tested during the start-up and/or service life of the well. This may occur, for example, when isolation has to be carried out between different zones in the well, when fluid has to be injected into the well, during perforation of pipes in the well, during cementation of the well and in a number of other operations. As a rule use is then made of one or more plugs (so-called well plugs) to perform this shutdown, where the plug(s) have to be able to withstand high pressure, high temperature in addition to a corrosive environment which may exist in such a well.

These plugs may either be retrievable or permanent, with the well conditions, the type of operation(s) to be conducted etc. determining which of these types of plug should be employed.

The retrievable plugs are recovered from the well after use by means of mechanical devices, which may, for example, be wirelines, "slick lines" or "coiled tubing". These plugs, however, particularly if they are left for too long in the well, have a tendency to jam, or they may also become deformed on account of the great pressures to which they are exposed, with the result that they cannot be retrieved from the well without considerable effort.

When using permanent plugs, these may be completely or partially destroyed by means of various mechanisms. Plugs of this kind may be made of a soft or reactive material, such as rubber, composite materials etc., where the material may either be decomposed or perforated by suitable means, thereby admitting a through-flow through the pipe or the well. For example, after a pressure-testing of a well is completed, a chemical can be added to the well to destroy the rubber plug when the plug requires to be removed. There will, however, be a high degree of uncertainty associated with ascertaining when the plug has been "removed", and whether it has been completely or only partially removed.

Permanent plugs may also be made of a brittle material, where the plug is smashed by means of suitable methods and mechanisms after the desired operation has been completed.

The use of plugs of this kind, which may be made of ceramic material, glass etc., is well known, and glass in particular is considered to be highly suitable within the oil industry. Glass is almost inert with respect to all types of chemicals and is safe for personnel handling the plug. The glass's properties also enable it to retain its strength at high temperatures and it can remain in an oil well for a very long time without being damaged or broken down.

In the known solutions a plug as mentioned above is removed by means of an explosive charge, with the result that the glass is smashed into small particles which are easily washed out of the well without leaving any remnants which may be harmful. These explosive charges can be incorporated in the actual plug, or mounted above the actual plug. The actual detonation is remotely controlled, and may be triggered from the surface of the well.

An example of a glass test plug, where the plug is arranged to be able to be removed by means of an explosive charge is known from NO B1 321.976. The plug comprises a number of layered or stratified ring discs of a given thickness, which are placed in abutment on top of one another. Between the different layers of the plug an intermediate film of plastic, felt or paper is inserted; the various glass layers may also be joined by means of lamination by an adhesive such as a glue. During use the plug will be mounted in a plug-receiving chamber in a tubing, where the underside of the plug rests in a seat at the bottom of the chamber. An explosive charge is furthermore incorporated in the top of the plug by one or more recesses being drilled out from the top of the plug, in which recesses the explosive charge(s) are placed.

The use of explosive charges for shattering test plugs can provide a safe and calculable removal of the plug. However, in many countries very stringent requirements are placed on the use and import of explosives, and it is therefore desirable to provide a solution where the test plug can be controllably removed without the use of such means.

SUMMARY OF THE INVENTION

Thus it is an object of the present invention to provide a device for controlling and/or operating tools or underwater equipment employed in connection with recovery of hydrocarbons offshore or onshore.

It is a further object of the present invention to provide a device which can activate or deactivate a tool or underwater equipment in an oil well in a safe and reliable manner, where the device is controlled by means of cyclic pressure loads to which it is subjected.

A further object of the present invention is to provide a device which can be installed together with the tool or the underwater equipment which is to be employed, or which can also be retrofitted.

Yet another object of the present invention is to provide a device where one seek to avoid or at least reduce the disadvantages of existing devices for control and operation of various tools and underwater equipment.

These objects are achieved with a device according to the attached claims, where further details of the invention will become apparent from the description below.

In a preferred embodiment the device according to the present invention is particularly intended for use together with a breakable well plug, but it should be understood that the device may also be employed for controlling or operating other types of tools, such as valves, opening and closing of various couplings etc.

A breakable well plug may, for example, be employed in connection with testing of production tubing for oil, gas and injection wells. The well plug comprises a sleeve-shaped element, where the sleeve-shaped element encloses a number of breakable strata and support bodies in a radial and a longitudinal direction of a tubing. With this assembly, which consists of alternate layers of support bodies and strata, closed chambers will be formed between the strata. These chambers are filled with fluid, such as water, oil or another suitable fluid.

The sleeve-shaped element may be placed in a housing, where the housing may furthermore be placed internally in production tubing, a liner or also a casing. In another embodiment the housing may also form a part of the tubing or as a third alternative the sleeve-shaped element may be employed without a surrounding housing. In this embodiment, however, the different parts have to be connected in a suitable manner so as to prevent the plug from falling apart.

The sleeve-shaped element also comprises a body, where the body further comprises at least one hydraulic valve slide. The body may be rearranged to form a connection between the closed fluid-filled chambers and one or more recesses forming a relief chamber. When a connection is formed, fluid from the fluid-filled chambers can flow from the chambers into the relief chamber, whereby the chambers are emptied and the breakable strata "weakened". One or more pin devices will then be able to produce a point load in one or more of the breakable strata in the well plug, in order thereby to further "weaken" the breakable strata, leading to a controlled disintegration of the well plug.

In order to activate the body in the breakable well plug, a device according to the present invention is employed. The device comprises an annular sleeve, where the annular sleeve may be integrated in the actual well plug, or it may be a separate part which can be connected in a suitable manner with the well plug. An alternative version may also be envisaged where the device may be placed at a distance from the well plug. The object of the device is to be able to control the disintegration and the opening of the well plug in a controlled manner.

The well plug and the device according to the present invention may, for example, be connected via a threaded connection, in which case the device may be designed to be able to be connected either externally or internally to the well plug's sleeve-shaped element, or "rapid couplings" of various kinds, bolts etc. may also be employed.

When the well plug is used for shutdown of a well which has to be pressure- and/or temperature-tested, the well plug and the device for controlling, activating and/or operating tools, instruments or underwater equipment according to the present invention are lowered to the desired area and then placed, for example, in a plug-receiving chamber or in another way in the production tubing. The well plug and the device according to the present invention will then provide a "shutdown" of the production tubing, whereupon pressure and/or temperature tests or other necessary tests can be conducted.

The device for controlling, activating and/or operating tools, devices and underwater equipment employed in connection with exploration and recovery of hydrocarbons offshore or onshore according to the present invention therefore comprises a hollow sleeve, where a movement mechanism, a stopper element and a block release element are arranged in non-through-going recesses in the body of the hollow sleeve. When the device according to the present invention is arranged in an elongated element, for example production tubing or a sleeve, the inside of the elongated element, a part of the outside of the hollow sleeve and a piston will define a volume in the device, where this volume contains a fluid. By applying, through suitable means, a number of cyclic loads in the form of pressure increases and reductions to a fluid located in the elongated element, on the top of the well plug, on application of repeated cyclic loads, the movement mechanism in the device according to the present invention will be moved relative to the stopper element and the block release element until the movement mechanism reaches a position where the block release element via a release pin will open up a connection between the volume and a number of relief recesses for discharging the volume, whereby at least one push rod is activated for operating the tool or the underwater equipment.

In an embodiment of the device according to the present invention the recesses in which the movement mechanism, the stopper element and the block release element are arranged, are formed adjacent to one another, whereby, when mounted in their respective recesses, the movement mechanism, the stopper element and the block release element will be in contact with one another.

The movement mechanism consists of an inner and outer slide, where the inner slide is mounted in the outer slide. The outer slide will furthermore be provided over at least a part of its length with a number of pawls, where the pawls are arranged on the outer slide's outside or outer surface. The pawls provided in the outer slide's outside or outer surface will cooperate with a number of pawls provided in the stopper element, where the pawls in the stopper element are arranged on a side of the stopper element facing and in contact with the outer sleeve's outside or outer surface.

In its outer surface, i.e. the surface which is in contact with an inner surface of the outer slide, the inner slide will be provided with a channel which is slanting from the inner slide's axial direction, in which channel a spring and a ball are mounted. The inner slide is furthermore connected in a suitable manner to a tension rod and at least one related spring, where the tension rod extends through a bore in the hollow sleeve into the volume defined by the inside of the production tubing, the piston and a part of the outside of the hollow sleeve. When the device according to the present invention is not subjected to a load in the form of an applied pressure (pressure increase), the spring in the slanting channel will press the ball in towards the outer slide's inner surface, whereby a friction is created between the outer and inner slide. When the device according to the present invention is subjected to a load in the form of an applied pressure, the piston in the device will attempt to equalize a pressure differential over the piston. The piston will then move in the device's axial direction until the pressure in the liquid in the volume is equal to the applied pressure. This pressure increase in the volume will cause the tension rod to be subjected to a force which will attempt to move the inner slide relative to the outer sleeve in the movement mechanism, with the result that the spring in the slanting channel in the inner slide will be compressed. This will furthermore cause the inner slide to be moved relative to the outer slide in the device's axial direction until the pressure to which the device is subjected decreases. The drop in pressure on the top of the well plug will cause a pressure differential to arise once again over the piston, where the piston will move in the device's axial direction until the pressure in the liquid in the volume will be equal to the pressure in the liquid in the production tubing located above the well plug. The result will be that the tension rod is no longer subjected to a pressure, thereby causing the spring to pull the tension rod back to its starting position (i.e. the position the tension rod had before the device was subjected to a load). The spring in the inner slide's slanting channel will then push the ball into abutment against the outer slide's inner surface, with the result that the outer slide will follow the inner slide's movement back towards its starting position. By means of this movement the outer slide will be moved a certain distance relative to the stopper element for each cyclic pressure load to which the device is subjected.

The pawls in the outer slide and the stopper element may be designed in several different ways, where the pawls must be of a shape that permits a relative movement between the outer slide and the stopper element in one direction, but prevents a movement of the outer slide and the stopper element in the opposite direction. In an embodiment of the device according to the present invention the pawls in the outer slide and the stopper element are provided with a slanting portion, which portion forms a sliding portion in addition to permitting a movement between the outer slide and the stopper element, and a horizontal stop portion, which portion will stop the relative movement between the outer slide and the stopper element.

In order to keep the stopper element in contact with the outer slide in the movement mechanism, an elastic device is also provided in the recess in which the stopper element is mounted. In this manner the elastic device will be compressed when the movement between the outer slide and the stopper element occurs over the pawls' slanted portion, and will be expanded again when two adjacent pawls' slanted portions are moved past each other. The two adjacent pawls will then be in abutment against each other via the stop portions. The elastic device may, for example, be composed of a spring, an elastic rubber element or the like.

The block release element, which is composed of a release pin and at least one roller or ball, is mounted in a recess adjacent to the movement mechanism. The release pin is then mounted in a channel which provides a connection between the volume and the at least one relief recess in the device, so that the connection between the volume and the at least one relief recess is closed before the device according to the present invention is used for operating a tool or underwater equipment. The release pin will be kept in its position in the channel, i.e. the position which closes the connection between the volume and the at least one relief recess, by the at least one roller or ball until a lower end of the outer sleeve in the movement mechanism has moved past the at least one roller or ball, thereby enabling the roller or the ball to "fall" out of the recess in which it is mounted. When the roller or the ball falls out of the recess, a pressure in the volume will be able to push the release pin so that the release pin is moved in the device's longitudinal direction in the channel. After the release pin has moved a certain length, the release pin will open up a connection between the volume and the at least one relief recess, thereby permitting liquid from the volume to flow out into the at least one relief recess through the channel.

In order to prevent leakage from occurring between the volume and the at least one relief recess in the device when the release pin shuts off or closes the connection between them, one or more sealing devices, such as O-rings or the like, may be mounted in the channel or to the release pin. A person skilled in the art will know how this should be done and it is therefore not explained further here.

Since the release pin has moved in the device's axial longitudinal direction, a connection will be opened as indicated above between the volume and the at least one relief recess, whereby the liquid located in the volume is permitted to flow out into the at least one relief recess. When this happens, on account of the pressure drop in the volume, and on account of the pressure existing in the production tubing in which the device is mounted, the piston will be moved in the device's axial direction, thereby bringing the piston into contact with at least one push rod which is mounted in a bore in the device. This will cause the piston to exert a force on the at least one push rod, where shear pins which are connected to the bore will be sheared, thereby causing the push rod to be pushed down through the device. The at least one push rod will then be brought into contact with an activation mechanism in the tool or the underwater equipment, for example a crushing mechanism in a well plug, so that the push rod activates the crushing mechanism in the well plug.

It should be understood that the device according to the present invention may comprise the use of a number of movement mechanisms, stopper elements and block release elements, for example two or four, in which case they may be mounted diametrically above one another. It should further be understood that several springs may be employed for controlling the tension rod's position.

The device according to the present invention will therefore be able to be automatically set at the pressure existing at the location in which the device is mounted, where the device will also be able to be preset to open according to a specifically required number of cyclic (pressure) loads.

Thus by means of the present invention a device is provided for controlling or operating the opening of, for example, a well plug, where the well plug is not opened inadvertently, where furthermore the time of the opening of the well plug can be precisely determined and where the well plug together with the device according to the present invention offer far greater flexibility with regard to the construction, use and safety of such well plugs.

Other advantages and special features of the present invention will become apparent from the following detailed description, the attached drawings and the following claims.

BRIEF DESCRIPTION OF THE DRAWINGS

The invention will now be described in greater detail with reference to the following figures, in which.

DETAILED DESCRIPTION OF THE INVENTION

Figure 6:
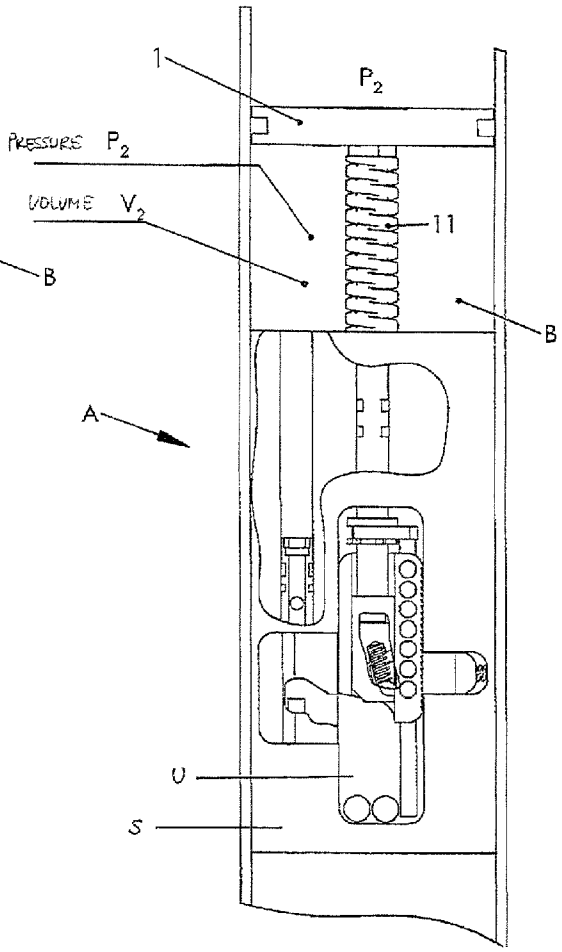
FIG. 6 illustrates the device according to the present invention when activated.
Figure 8:
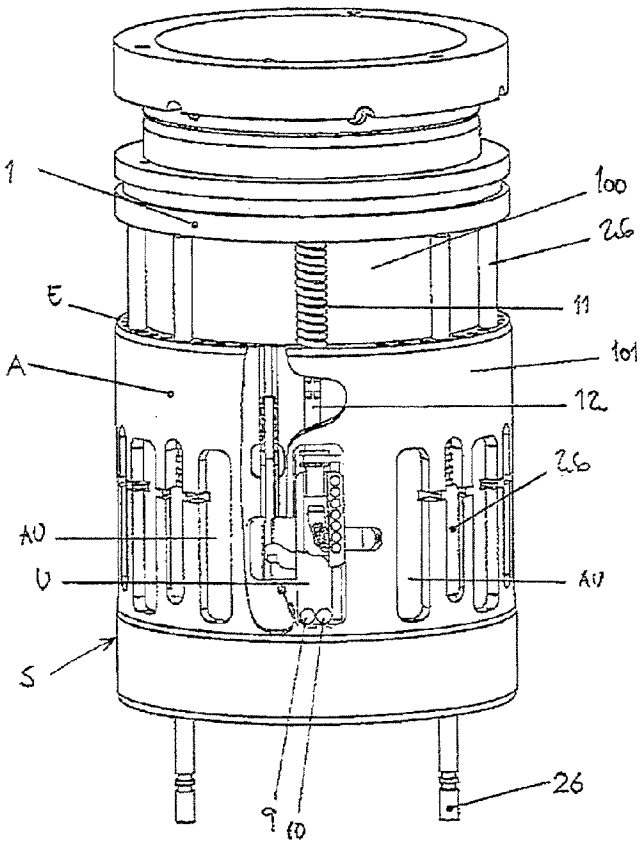
FIG. 8 is a perspective view of the device according to FIG. 6.
Figure 7:
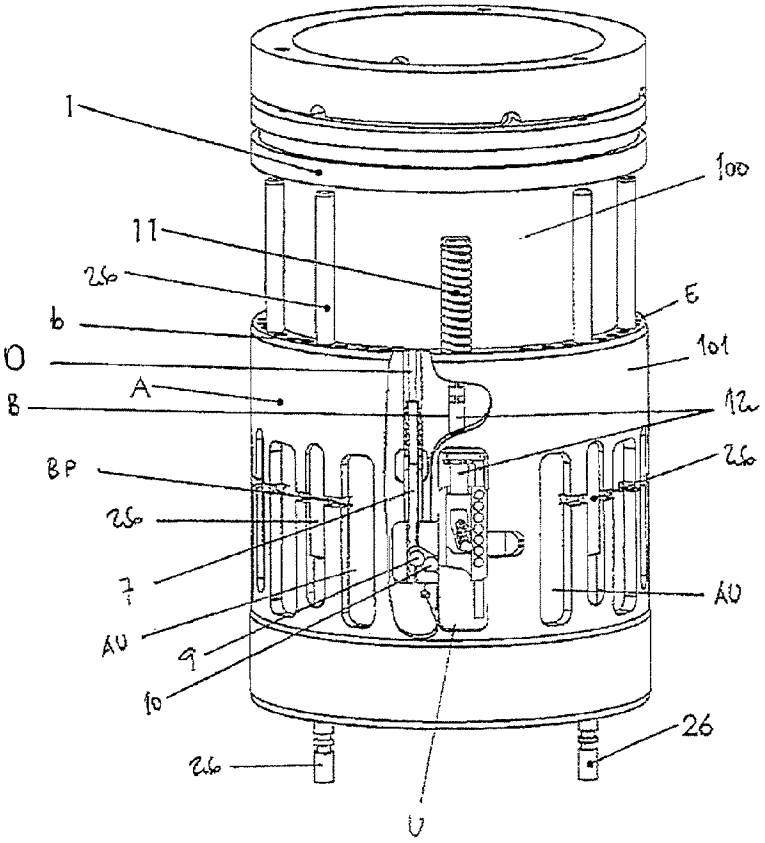
FIG. 7 is a perspective view of the device according to FIG. 5.

For the sake of simplicity FIGS. 1-6 do not illustrate all the elements included in a device A according to the present invention, only a movement mechanism M, a stopper element and a block release element being illustrated in these figures. FIGS. 7-8 illustrate the device A according to the present invention with all the elements included in the device A.

Figure 1:
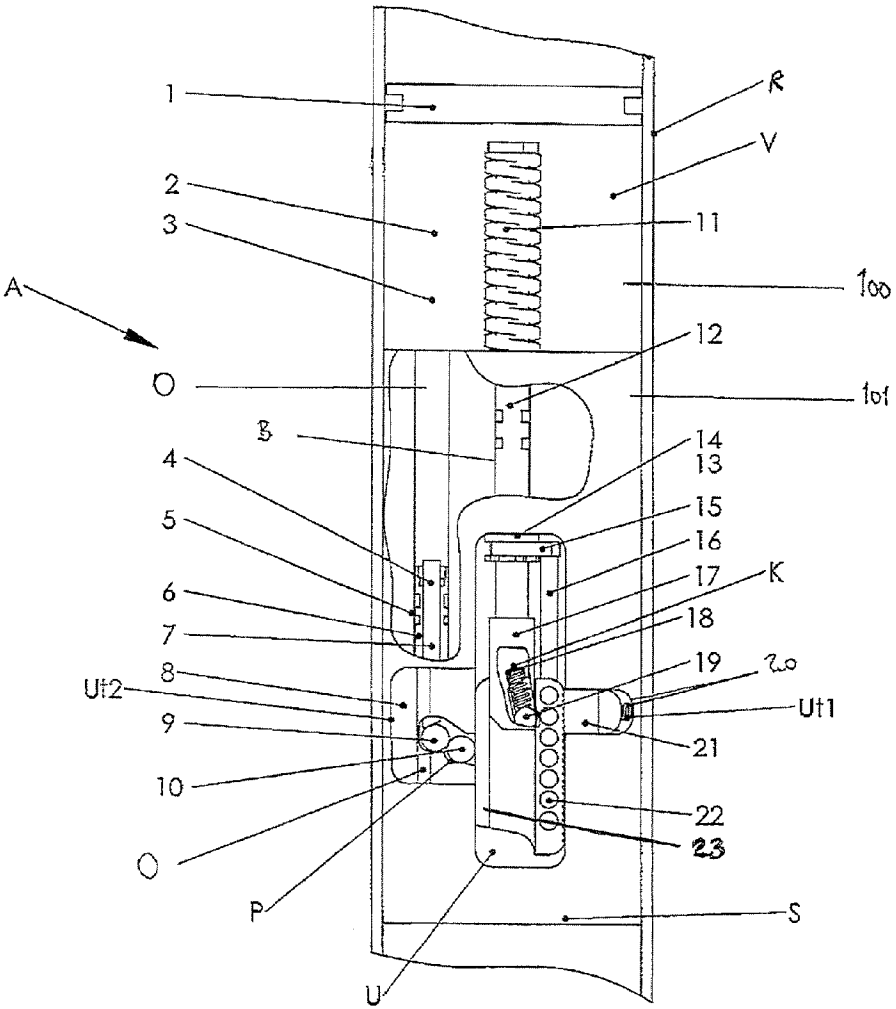
FIG. 1 is a partial cross section of an embodiment of the device according to the present invention.

FIG. 1 illustrates a device A according to the present invention, where the device A comprises a hollow sleeve S which in an embodiment may be annular, where the device A is arranged in an elongated hollow element R, for example production tubing, a sleeve or the like. The device A is then secured close to or adjacent to a tool or underwater equipment (not shown) which has to be controlled and/or activated by the device A. The hollow sleeve S may be made of any suitable material, where the material should be able to withstand the pressures and/or temperatures existing in a well. The outer surface (the body) of the hollow sleeve S is provided with a number of recesses U, where the recesses U are arranged round the whole or parts of the hollow sleeve's S external circumference. In an embodiment of the device A four recesses U are arranged round the hollow sleeve's circumference, where the recesses U are arranged in twos diametrically above each other. Over a part 100 of its length, the hollow sleeve S is furthermore machined or prepared in such a manner that a part of the hollow sleeve's body is removed (see FIGS. 7 and 8). The result is that over this part 100 the hollow sleeve S will have an external diameter which is smaller than a diameter of a part 101 of the hollow sleeve S where the recess U is arranged. An end surface E, see FIGS. 7 and 8, will then form a partition between the machined part 100 and the part 101 in the hollow sleeve S. An annular piston 1, which has an internal diameter substantially equal to the external diameter of the machined part 100 of the hollow sleeve S, will then be mounted over the machined part 100 of the hollow sleeve S. When the device A is arranged in the elongated hollow element R, the part 101 of the hollow sleeve S in which the recess U is provided, the annular piston 1 and an internal diameter of the elongated hollow element R will define a closed volume V which is filled with a liquid. The part 101 of the hollow sleeve S will then have an external diameter which substantially corresponds to the internal diameter of the elongated element R.

From the recess U a bore B is provided extending out through the end surface E. In this bore B a tension rod 12 is mounted, where the tension rod 12 forms a part of a movement mechanism M. One end of the tension rod 12 is connected to a spring 11, while an opposite end of the tension rod 12 is connected to an inner slide 17. The connection between the tension rod 12 and the inner slide 17 may, for example, be composed of a threaded connection (not shown). The tension rod 12 is also further connected via a nut 14 and a driving device 15 in the form of a plate element to a rod 16. The rod 16 is further connected with an outer slide 23. The inner slide 17 will then be arranged located within the outer slide 23 in an assembled device A.

The movement mechanism M will then be able to be influenced by a load in the form of a pressure increase to which the device A is subjected, where, after a number of loads, the movement mechanism M together with a stopper element 21 and a block release element 8 will release at least one push rod 26, where the at least one push rod 26 is used for controlling and/or activating a tool or an underwater implement (not shown).

The inner slide 17 will be provided with a channel K which is slanting relative to the inner slide's 17 longitudinal direction, in which channel K a spring 18 and a ball 19 are mounted. When the inner slide 17 is arranged in the outer slide 23, the ball 19 will abut against the outer slide's 23 inner wall, thereby forming a pressure connection between the inner and outer slides 17, 23.

On one of its sides, over at least a part of its length, the outer slide 23 will be provided with a number of pawls S, where these pawls S cooperate with corresponding pawls S provided in the stopper element 21 mounted in a recess Ut1 adjacent to the recess U. A spring element 20 will then press the stopper element's 21 pawls S into engagement with the outer slide's 23 pawls S.

The pawls S in the outer slide 23 and the stopper element 21 are designed so as to permit a relative movement between the outer slide 23 and the stopper element 21 in one direction, but prevent a movement of the outer slide 23 and the stopper element 21 in the opposite direction, where, for example, the pawls S may be provided with a slanting portion, which portion forms a sliding portion and in addition permits a movement between the outer slide 23 and the stopper element 21, and a horizontal stop portion, which portion will stop the relative movement between the outer slide and the stopper element. However, a person skilled in the art will know how this should be done and it is therefore not described further here.

In a recess Ut2, adjacent to the recess U, and arranged on the opposite side of the recess Ut1, a block release element 8 is provided. In the block release element 8 a passage P is provided where two rollers 9, 10 are mounted in the passage P. The rollers 9, 10 block the passage of a release pin 7 through the device A, the release pin 7 then being prevented by the rollers 9, 10 from moving through the hole O in the device's A longitudinal direction, in which hole 0 the release pin 7 is located.

The hole O will further extend through the device A, from the recess Ut2 out through the end surface E, thereby forming a connection between the closed volume V and at least one relief recess AU provided in the body of the hollow sleeve S.

In the device A there is further provided at least one bore b, where a push rod 26 is mounted in the bore b. The bore b will extend from the closed volume V through the device's A longitudinal direction, and out through an end of the device A which is opposite the piston 1. A number of shear pins BP are furthermore connected to the at least one bore b, where the shear pins BP will keep the push rod 26 in an inactive condition until the push rod 26 is subjected to a load from the piston 1.

Figures 2, 3, 4:
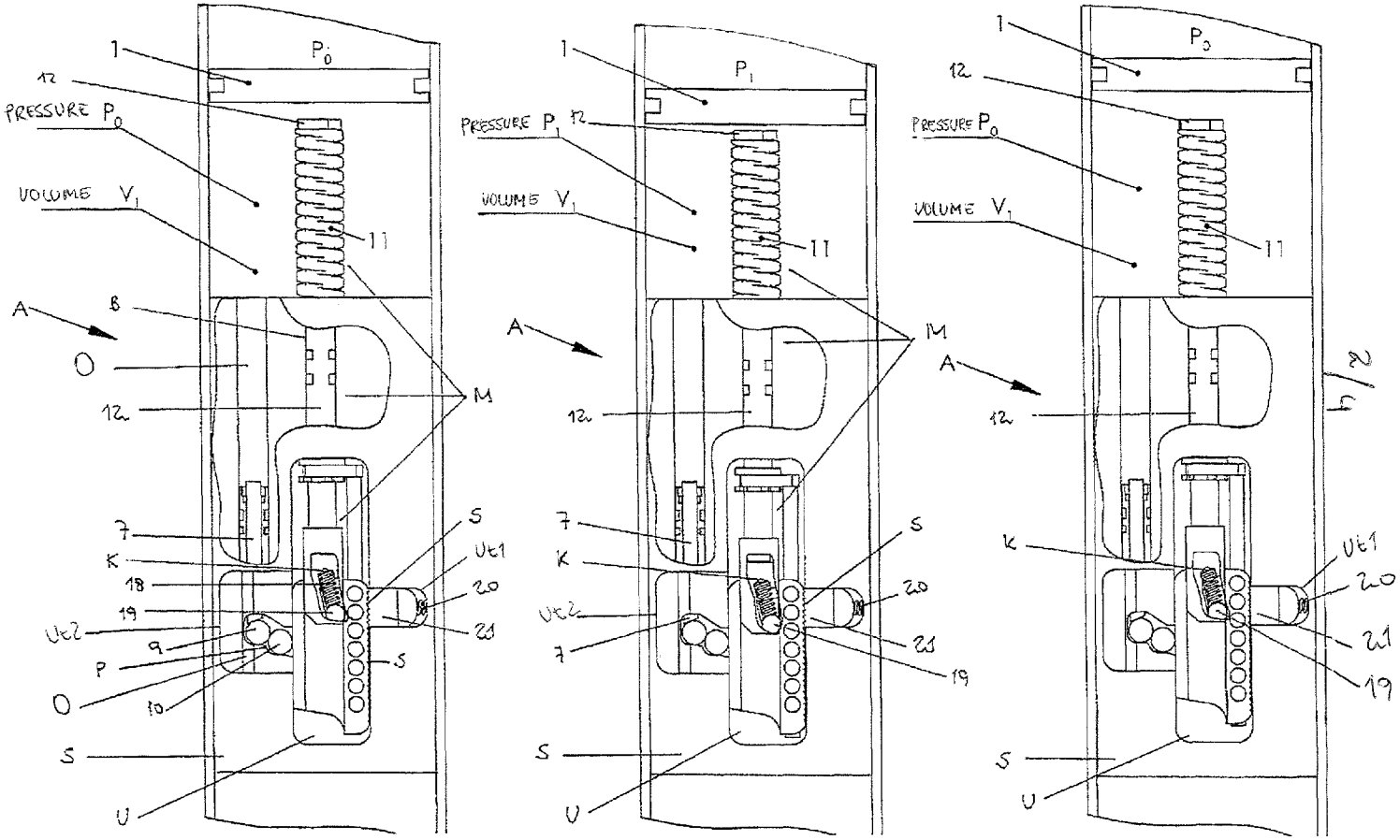
FIGS. 2 to 4 illustrate the device according to the present invention which is subjected to cyclic pressure loads.

The device's A mode of operation will now be explained in more detail in relation to FIGS. 2 to 4, where FIG. 2 illustrates the device A according to the present invention arranged in the elongated element R, for example production tubing and in connection with tools or underwater equipment (not shown), for example a well plug, which the device A has to control and/or operate. The well plug (not shown) will then form a barrier in the elongated element R, with the result that there is a liquid on both the top and bottom of the well plug, where, for example, the liquid on the top of the well plug will have a pressure P0. The annular piston 1 will then be subjected to a pressure P0 which is on the top of the device A. The pressure in the closed volume V will then be the same pressure P0 as that to which the piston 1 is subjected; if the pressure P0, for example, is 150 bar in the elongated element R, the pressure in the closed volume V will also be PO equals 150 bar, while the volume will be V1. Thus in FIG. 2 the illustrated device A will assume a "position of equilibrium" or a condition which does not influence the device A. The surface of the tension rod 12 will therefore be subjected to this pressure P0 (150 bar), but on account of the fact that the spring 11 has a spring constant which is greater than 150 bar, the spring 11 will not permit the tension rod 12 to move.

In FIG. 3, however, the device A will be subjected to a pressure P1, where the pressure P1 is the pressure P0 in addition to a certain applied pressure in the elongated element R (applied externally to the elongated element R), which, for example, may be 200 bar. The pressure P1 to which the annular piston 1 is subjected will therefore now be 350 bar (150 bar+200 bar), whereby the annular piston 1 will be moved down towards the spring 11 and the tension rod 12. The annular piston's 1 movement down towards the spring 11 and the tension rod 12 will cause the pressure in the closed volume V to increase, so that the pressure P1 in the volume V increases to 350 bar, while the volume V1 remains the same as shown in FIG. 2. The pressure increase, however, will cause the tension rod 12 to be subjected to a force which the spring 11 is unable to withstand, whereby the spring 11 will be compressed and the tension rod 12 permitted to travel downwards in the device A, through the bore B. The tension rod's 12 travel will cause the ball 19 in the inner slide 17 to compress the spring 18, whereby the inner sleeve 17 is permitted to be moved relative to the outer slide 23. When the applied pressure (200 bar) in the production tubing is bled off, as illustrated in FIG. 4, the spring's 11 spring constant will again be so great that the tension rod 12 is brought back to its starting position as illustrated in FIG. 2. The tension rod's 12 travel back to its starting position will cause the outer slide 23 to accompany the inner slide's 17 movement. The movement of the outer slide 23 upwards in the device A will further cause the spring element 20 which is connected with the stopper element 21 to be compressed, whereby two adjacent pawls S in the outer slide 23 and the stopper element 21 are permitted to pass each other and thereafter be securely locked together.

Thus in FIGS. 2 to 4 the device A has been subjected to a cyclic loading in the form of a pressure increase, with the result that the outer slide 23, on the return of the tension rod 12 to its starting position as illustrated in FIG. 2, has moved a certain distance, corresponding to a length of a pawl S, upwards in the device A. This has also caused the end termination of the outer sleeve 23, which covers the rollers 9, 10 in the block release element 8, to be pushed closer to the rollers 9, 10, which will be repeated for each cyclic loading.

Figure 5:
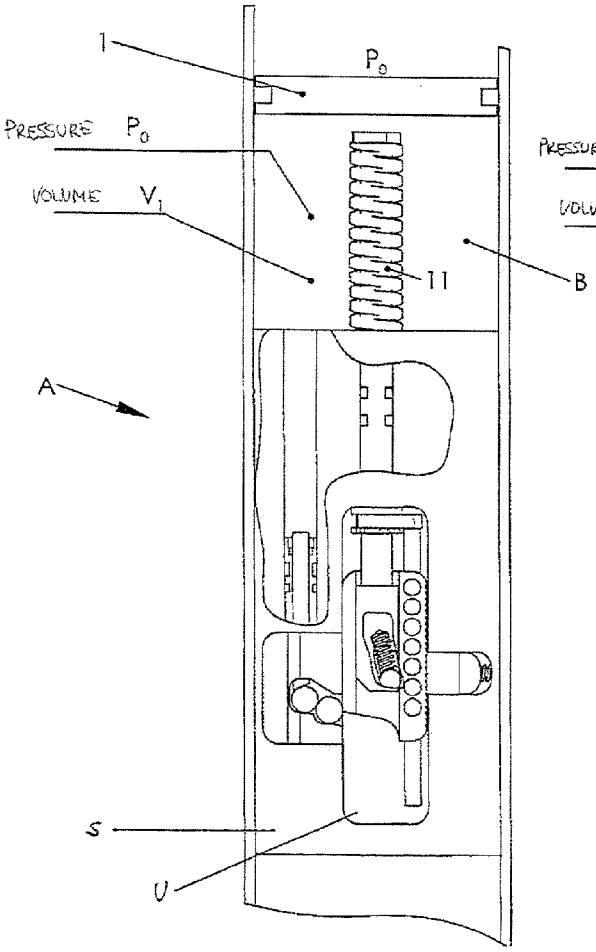
FIG. 5 illustrates the device according to the present invention immediately before the device is activated.

In FIG. 5 the device A according to the present invention has been subjected to a given number of cyclic loads, and it can be seen that the outer slide's 23 end termination has now almost completely uncovered the rollers 9, 10 arranged in the passage P. The pressure to which the piston 1 is subjected is again P0, and the pressure in the volume V will also be P0. On the next cyclic loading, as illustrated in FIG. 6, the outer slide 23 will again move upwards in the device A as explained above, thereby uncovering the rollers 9, 10 completely. The rollers 9, 10 will then fall out of the passage P, with the result that they will no longer block the release pin 7. On account of the hole A, the release pin 7 will then be subjected to the pressure which is in the volume V, and will then be moved in the hole O's longitudinal direction, thereby enabling fluid which is in the volume V to flow out of the volume V and out into the at least one relief recess AU through the hole O.

This causes the pressure in the volume V to be considerably reduced, whereby the annular piston 1, on account of the pressure P2 which is in the production tubing, will be moved down towards the at least one push rod 26 which is mounted in the bore b, with the result that the push rod 26 is subjected to a force. This force will be so great that the shear pins BP will be sheared, thereby enabling the push rod 26 to be employed for activating an activation mechanism in, for example, a well plug.

FIG. 7 illustrates the device A according to FIG. 5 in a perspective view, where it can be seen that the device A comprises a hollow sleeve S. All elements in the device A are further illustrated in the figure. As indicated above, the device A will be depicted in a condition immediately before the outer sleeve's 23 end termination has partly uncovered the rollers 9, 10, where the next cyclic load will cause the rollers 9, 10 to be completely uncovered, as illustrated in FIG. 8, whereby the rollers 9, 10 will fall down into the recess U. The push rods 26 will still be in a non-activated position as the rollers 9, 10 are still blocking a movement of the release pin 7.

In FIG. 8 the device A has been subjected to a further cyclic loading, with the result that the outer sleeve's 23 end termination has been moved past the rollers 9, 10, so that the rollers 9, 10 have fallen down into the recess U. The rollers 9, 10 will now not block the release pin 7, thereby enabling the release pin 7 to move in the hole's O's longitudinal direction. By means of the release pin's 7 movement a connection is opened between the closed volume V and one or more relief recesses AU, thereby enabling liquid from the closed volume V to flow from the volume V out into the relief recesses AU. This causes the pressure which is in the closed volume V to drop considerably, whereby the pressure acting on the annular piston 1 will push the annular piston 1 against the push rods 26. When the annular piston 1 is brought into contact with the push rods 26, the push rods 26 will be subjected to so great a load that the shear pins BP securing the push rods 26 will be sheared, thereby permitting the push rods 26 to be moved in the device's A axial direction, as illustrated in FIG. 8, where the push rods 26 have now been moved out of the device A. The movement of the push rods 26 will then be used to control and/or activate the tool or the underwater equipment (not shown) close to or adjacent to which the device A according to the present invention is located.

The present invention has now been explained in connection with an embodiment, where it will be appreciated that several changes and/or modifications of the invention may be implemented within the scope of the claims.

The invention claimed is:

1. A device for operating tools, devices or underwater equipment employed in connection with exploration and recovery of hydrocarbons, characterised in that the device comprises a hollow sleeve, where a movement mechanism comprising an inner slide and an outer slide provided with pawls, a stopper element provided with pawls and a block release element provided with a passage, in which passage at least one roller is mounted, are arranged in non-throughgoing recesses in the body of the hollow sleeve, the movement mechanism, the stopper element and the block release element being in contact with one another and a closed volume defined by a part of the hollow sleeve, an annular piston and an elongated hollow element, which closed volume contains a fluid, where, upon cyclic loading, in the form of pressure increases and reductions to the fluid, of the device, the outer slide of the movement mechanism will be moved relative to the stopper element and the block release element until a position where the block release element via a release pin will open up a connection between the closed volume and a number of relief recesses, whereby at least one push rod through the annular piston is activated for operating the tool or the underwater equipment.

2. A device according to claim 1, characterised in that the recesses are arranged adjacent to one another.

3. A device according to claim 1, characterised in that the inner slide (17) is provided with a channel, in which channel a spring and a ball are located.

4. A device according to claim 3, characterised in that the channel is slanting relative to the inner slide's longitudinal direction.

5. A device according to claim 1, characterised in that the outer slide is slidably connected to a tension rod.

6. A device according to claim 1, characterised in that at least one spring is connected to the tension rod .

7. A device according to claim 1, characterised in that at least one bore is provided in the device, in which bore at least one push rod is mounted.

8. A device according to claim 7, characterised in that the bore (b) extends from the volume through the device's longitudinal direction.

9. A device according to claim 7, characterised in that shear pins are provided in connection with the at least one bore.

10. A method for controlling a device for operating tools, devices or underwater equipment employed in connection with exploration and recovery of hydrocarbons, characterised in that during operation of tools or underwater equipment, a plurality of high, cyclic pressures in the form of pressure are applied to a fluid in an elongated element, where for each cyclic pressure an outer slide provided with pawls of a movement mechanism will be moved relative to a stopper element provided with pawls and a block release element provided with a passage, in which passage at least one roller is mounted, until a position where, via a release pin, the block release element opens up a connection between a closed volume and a number of relief recesses, where at least one push rod through an annular piston is activated for operating the tool or the underwater equipment.

* * * * *